US008667936B2

(12) United States Patent
Kajiura et al.

(10) Patent No.: US 8,667,936 B2
(45) Date of Patent: Mar. 11, 2014

(54) VALVE CONTROL APPARATUS FOR INTERNAL COMBUSTION ENGINE

(75) Inventors: Mikihiro Kajiura, Inagi (JP); Yoshihiko Yamada, Fujisawa (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 736 days.

(21) Appl. No.: 12/964,409

(22) Filed: Dec. 9, 2010

(65) Prior Publication Data

US 2011/0139102 A1 Jun. 16, 2011

(30) Foreign Application Priority Data

Dec. 16, 2009 (JP) ..... 2009-284628

(51) Int. Cl.
*F01L 1/34* (2006.01)

(52) U.S. Cl.
USPC ..... 123/90.16

(58) Field of Classification Search
USPC ..... 123/90.15, 90.16, 90.39
See application file for complete search history.

(56) References Cited

U.S. PATENT DOCUMENTS 7,600,496 B2 * 10/2009 Nakamura et al. ..... 123/90.16
7,739,991 B2 * 6/2010 Kotani et al. ..... 123/90.44
8,006,658 B2 * 8/2011 Nakamura et al. ..... 123/90.16
8,210,154 B2 * 7/2012 Nakamura et al. ..... 123/348
8,459,219 B2 * 6/2013 Fukami et al. ..... 123/90.16
8,544,429 B2 * 10/2013 Nakamura et al. ..... 123/90.16
2009/0050086 A1 2/2009 Takemura et al.

FOREIGN PATENT DOCUMENTS

JP 2008-144618 A 6/2008
JP 2009-47083 A 3/2009
JP 2009-180114 A 8/2009

OTHER PUBLICATIONS

Japanese Office Action dated Feb. 7, 2012 (three (3) pages).

* cited by examiner

*Primary Examiner* — Thomas Denion
*Assistant Examiner* — Daniel Bernstein
(74) *Attorney, Agent, or Firm* — Crowell & Moring LLP

(57) ABSTRACT

A valve control apparatus includes a drive shaft; a control shaft including a control shaft main body configured to be rotationally controlled according to a state of engine, and a control eccentric shaft located eccentrically relative to a rotation center of the control shaft main body; a rocker arm swingably supported by the control eccentric shaft and configured to convert a rotational motion of the drive shaft to a swinging motion; and a swing cam configured to open/close an engine valve according to the swinging motion of rocker arm. Both ends of the control eccentric shaft are formed with fixing holes extending in a radial direction of the control eccentric shaft. The control shaft main body is formed with insertion holes passing through the control shaft main body in a radial direction of the control shaft main body. The insertion holes respectively face the fixing holes. The control eccentric shaft is fixed to the control shaft main body by bolts. The bolts pass respectively through the pair of insertion holes and are screwed respectively into the fixing holes.

10 Claims, 10 Drawing Sheets

VALVE CONTROL APPARATUS FOR INTERNAL COMBUSTION ENGINE

BACKGROUND OF THE INVENTION

The present invention relates to a valve control apparatus for an internal combustion engine, which is able to vary a lift-amount characteristic, a working angle (valve-open period) or the like of an intake valve or an exhaust valve functioning as an engine valve, in accordance with an operating state of the engine.

In the field of a valve control apparatus functioning to vary a valve lift amount or working angle of the engine valve through a rocker arm by controlling a rotation of control shaft, it is required that an operational control range of the valve lift amount or the like of the engine valve is enlarged by widely varying a swing fulcrum of the rocker arm.

United States Patent Application Publication No. 2009/0050086 (corresponding to Japanese Patent Application Publication No. 2009-47083) discloses a previously-proposed valve control apparatus. In this technique, the control shaft is integrally formed in a crank shape in order to secure a large distance between a rotation center of the control shaft and the swing fulcrum of the rocker arm.

SUMMARY OF THE INVENTION

However, in the technique disclosed in the above Application, since the control shaft is formed integrally in the crank shape, the rocker arm cannot be attached to the control shaft from an axial direction of the control shaft. Hence, a base end portion of the rocker arm is formed as pieces divided in a radial direction of the control shaft, and the divided pieces are firmly connected with each other by bolts at the time of assembly. Accordingly, a weight (inertia mass) of whole of the rocker arm is increased, and thereby, there is a risk that an operating performance of the rocker arm is worsened at the time of high-speed operation.

It is therefore an object of the present invention to provide a valve control apparatus devised to solve or ease the above problem.

According to one aspect of the present invention, there is provided a valve control apparatus for an internal combustion engine, comprising: a drive shaft configured to receive a rotational drive force; a control shaft including a control shaft main body configured to be rotationally controlled according to a state of the engine, wherein the control shaft main body is formed with a pair of insertion holes passing through the control shaft main body in a radial direction of the control shaft main body, and a control eccentric shaft located to have an eccentricity relative to a rotation center of the control shaft main body, wherein both ends of the control eccentric shaft are formed with a pair of fixing holes extending in a radial direction of the control eccentric shaft, wherein the pair of insertion holes respectively face the pair of fixing holes; a rocker arm swingably supported by the control eccentric shaft and configured to convert a rotational motion of the drive shaft to a swinging motion; and a swing cam configured to open and close a valve of the engine by swinging according to a swinging force transmitted from the swinging motion of the rocker arm, wherein the control eccentric shaft is fixed to the control shaft main body by bolts, wherein the bolts pass respectively through the pair of insertion holes and are screwed respectively into the pair of fixing holes.

According to another aspect of the present invention, there is provided a valve control apparatus for an internal combustion engine, comprising: a drive shaft configured to receive a rotational drive force; a control shaft including a control shaft main body configured to be rotationally controlled according to a state of the engine, wherein the control shaft main body is formed with a pair of fixing holes extending in a radial direction of the control shaft main body, and a control eccentric shaft located to have an eccentricity relative to a rotation center of the control shaft main body, wherein both ends of the control eccentric shaft are formed with a pair of insertion holes passing through the control eccentric shaft in a radial direction of the control eccentric shaft, wherein the pair of insertion holes respectively face the pair of fixing holes; a rocker arm swingably supported by the control eccentric shaft and configured to convert a rotational motion of the drive shaft to a swinging motion; and a swing cam configured to open and close a valve of the engine by swinging according to a swinging force transmitted from the swinging motion of the rocker arm, wherein the control eccentric shaft is fixed to the control shaft main body by bolts, wherein the bolts pass respectively through the pair of insertion holes and are screwed respectively into the pair of fixing holes.

According to still another aspect of the present invention, there is provided a valve control apparatus for an internal combustion engine, comprising: a drive shaft configured to receive a rotational drive force; a control shaft including a control shaft main body configured to be rotationally controlled according to a state of the engine, wherein the control shaft main body is formed with a pair of insertion holes passing through the control shaft main body in a radial direction of the control shaft main body, and a control eccentric shaft located to have an eccentricity relative to a rotation center of the control shaft main body, wherein both ends of the control eccentric shaft are formed with a pair of fixing holes extending in a radial direction of the control eccentric shaft, wherein the pair of insertion holes respectively face the pair of fixing holes; a rocker arm swingably supported by the control eccentric shaft and configured to convert a rotational motion of the drive shaft to a swinging motion; a swing cam configured to open and close a valve of the engine by swinging according to a swinging force transmitted from the swinging motion of the rocker arm; and a fixing member fixing the control eccentric shaft to the control shaft main body by means of an axial force of the fixing member which is applied through the insertion holes and the fixing holes.

The other objects and features of this invention will become understood from the following description with reference to the accompanying drawings.

DETAILED DESCRIPTION OF THE INVENTION

Figure 1:
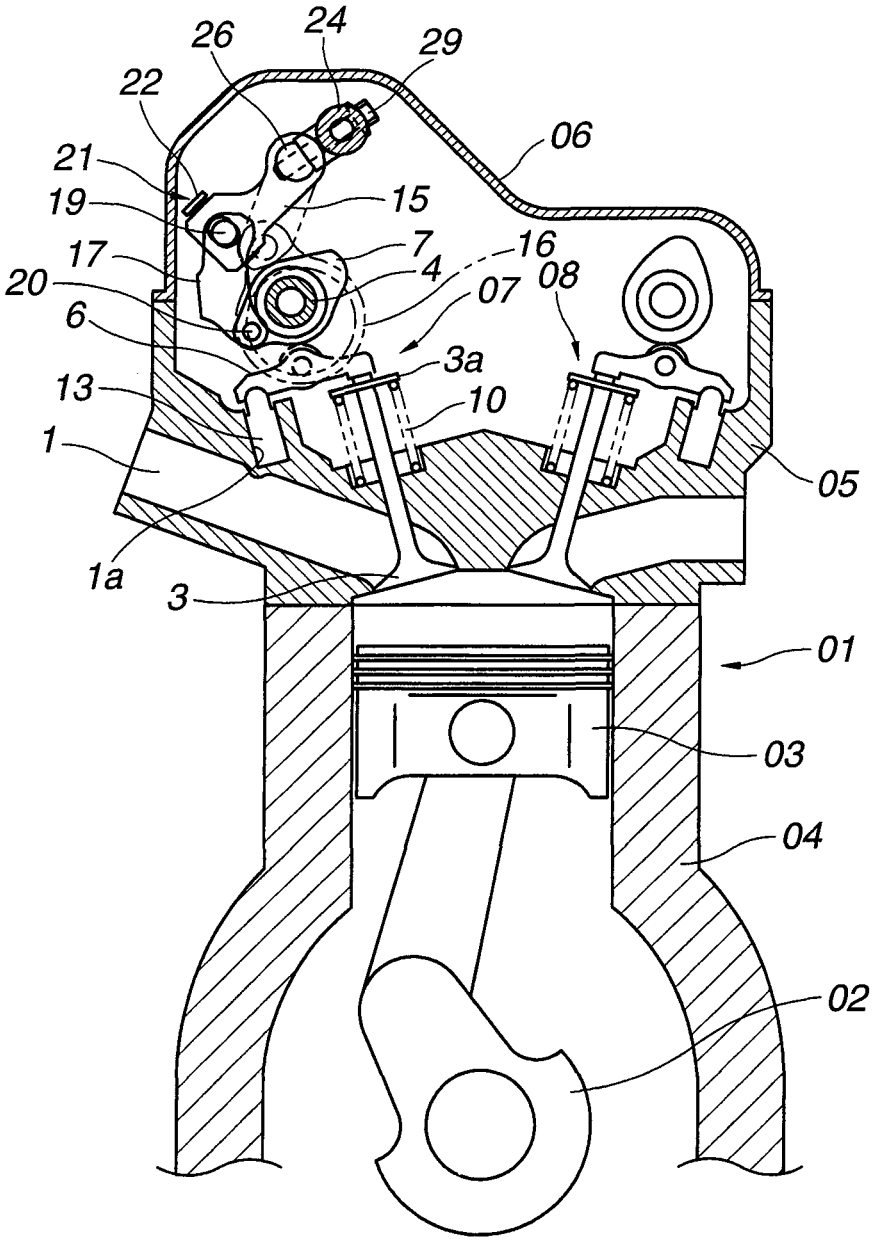
FIG. 1 is a schematic longitudinally-cross-sectional view of an internal combustion engine to which embodiments according to the present invention are applied.

Hereinafter, embodiments of valve control apparatus for an internal combustion engine according to the present invention will be described in detail, referring to the drawings. In the respective embodiments, the valve control apparatus is applied to intake sides of three cylinders in one cylinder bank of a V-type six-cylinder internal combustion engine.

[First Embodiment]

As shown in FIG. 1, an internal combustion engine 01 includes a cylinder block 04, a cylinder head 05, an intake-side valve control apparatus 07, and an exhaust-side valve control apparatus 08. The cylinder block 04 accommodates and rotatably receives a crankshaft 02 therein, and slidably receives a piston 03 in a cylinder bore. The cylinder head 05 is provided on the cylinder block 04 and fixed to an upper end of the cylinder block 04. An upper end of the cylinder head 05 is covered or enclosed by a head cover 06. The intake-side valve control apparatus 07 and the exhaust-side valve control apparatus 08 are provided at an upper end portion of the cylinder head 05, every cylinder. The intake-side valve control apparatus 07 includes a variable mechanism for varying a valve lift-amount characteristic and a working angle (angle range of valve-open period) of an intake valve 3 in accordance with an operating state of the engine.

As shown in FIGS. 1-3 and 6A-7B, the intake-side valve control apparatus 07 equipped with the variable mechanism includes two intake valves 3 and 3, a drive shaft 4, a pair of swing cams 7 and 7, a transmission mechanism 8, and a control mechanism 9. The two intake valves 3 and 3 are provided to each cylinder (i.e., one cylinder has two intake valves in this embodiment). Each of the two intake valves 3 and 3 is slidably arranged in the cylinder head 05 through a valve guide (not shown), and functions to open and close an intake port 1. The drive shaft 4 is disposed in a front-rear direction of the engine, and is formed in an internally hollow shape. The pair of swing cams 7 and 7 function to open and close the respective intake valves 3 and 3 through swing arms 6 and 6. The swing arms 6 and 6 are followers disposed respectively on upper end portions of the intake valves 3 and 3. The transmission mechanism 8 links between an after-mentioned drive cam 5 of the drive shaft 4 and the pair of swing cams 7 and 7. Thereby, the transmission mechanism 8 converts a rotational force of the drive cam 5 to a swinging motion, and transmits this swinging motion to the swing cams 7 and 7 as a swinging force. The control mechanism 9 controls the intake valves 3 and 3 so as to continuously vary the lift-amount characteristic and the working angle of each intake valve 3 in accordance with the operating state of engine, by varying an attitude (position range) of the transmission mechanism 8 and thereby varying a swing range of the swing cam 7. In this embodiment, the valve working angle means a time period for which the intake valve 3 is open.

Each of the intake valves 3 and 3 is biased (urged) by a valve spring 10 in a direction that closes (blocks) an open end of the intake port 1. The valve spring 10 is resiliently attached between a bottom portion of an approximately-cylindrically-shaped bore formed in an upper end portion of the cylinder head 05 and a spring retainer 3*a* provided to an upper end portion of valve stem.

The drive cam 5 is provided on an outer circumference of the drive shaft 4. The drive shaft 4 is rotatably supported by five bearing portions (not shown) provided in an upper portion of the cylinder head 05. Moreover, a timing sprocket (not shown) is provided on one end portion of the drive shaft 4, and thereby, rotational force is transmitted from the crankshaft 02 of engine through the timing sprocket to the drive shaft 4. Thus, the drive shaft 4 is able to rotate in a clockwise direction (arrow direction) of FIGS. 6A and 6B.

Figure 5:
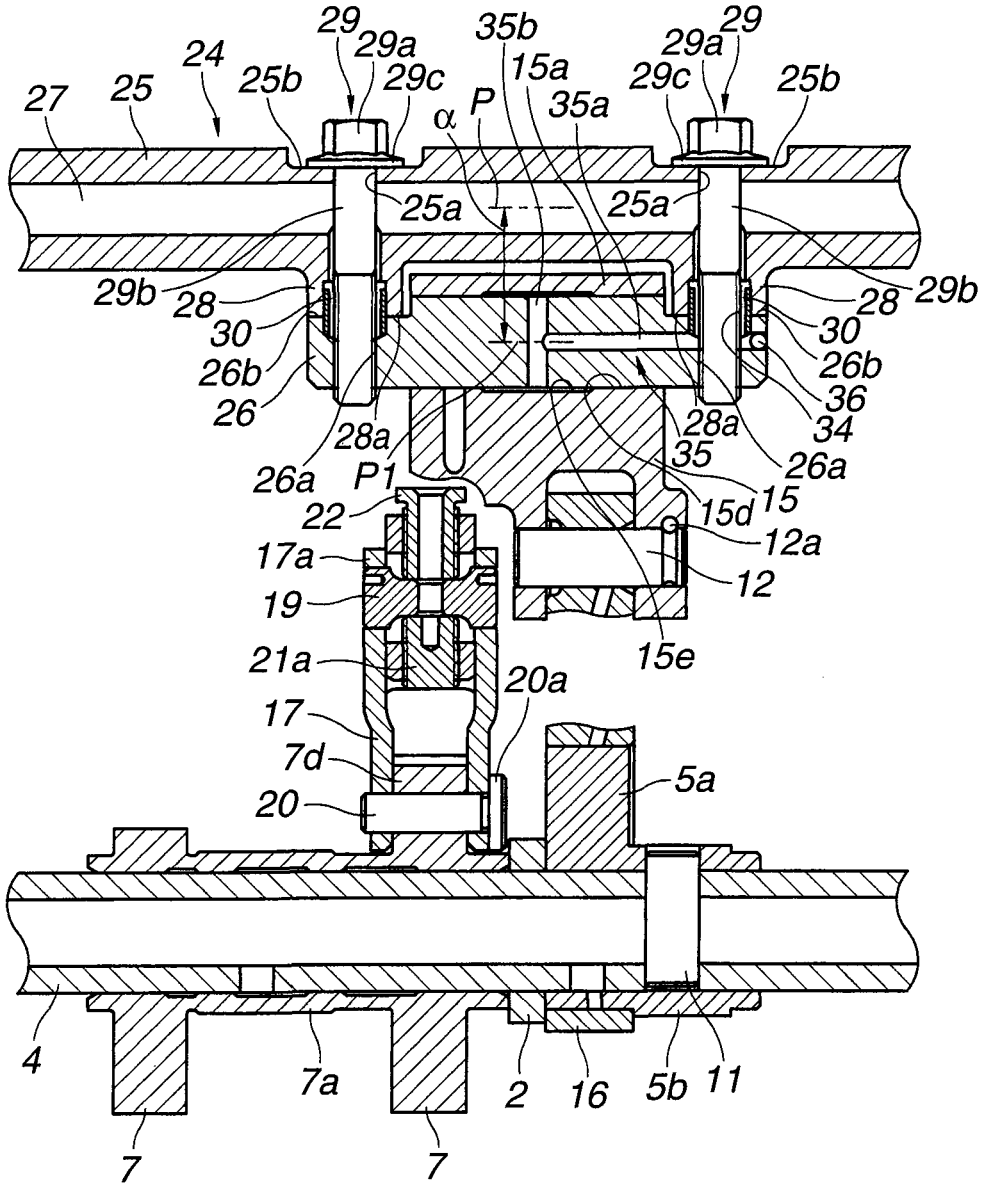
FIG. 5 is a longitudinally-cross-sectional view of the main part in the first embodiment.

The drive cam 5 includes a cam main body 5*a* and a boss portion 5*b*. The cam main body 5*a* is formed approximately in a disc shape. The boss portion 5*b* is formed in a tubular shape, and is provided integrally with an (axially) outside portion of the cam main body 5*a*. The drive cam 5 is fixed to the drive shaft 4 by a fixing pin 11. The fixing pin 11 passes through a pin hole which was drilled in the boss portion 5*b* in a radial direction. Moreover, the drive cam 5 is disposed on one end side of the swing cams 7 and 7 relative to an axial direction of drive shaft 4. The boss portion 5*b* is located on an opposite side of the cam main body 5*a* from the swing cams 7 and 7. Hence, as shown in FIG. 5, the cam main body 5*a* is closer to the swing cams 7 and 7 than the boss portion 5*b* in the axial direction, namely, is located through a spacer 2 adjacent to the swing cams 7 and 7. An outer circumferential surface of the cam main body 5*a* is formed in a cam profile of eccentric circle. That is, a shaft center Y of the cam main body 5*a* (i.e., a center of the outer circumferential surface of cam main body 5*a*) is offset (deviated) from a shaft center X of the drive shaft 4 by a predetermined amount in the radial direction.

Figure 6B:
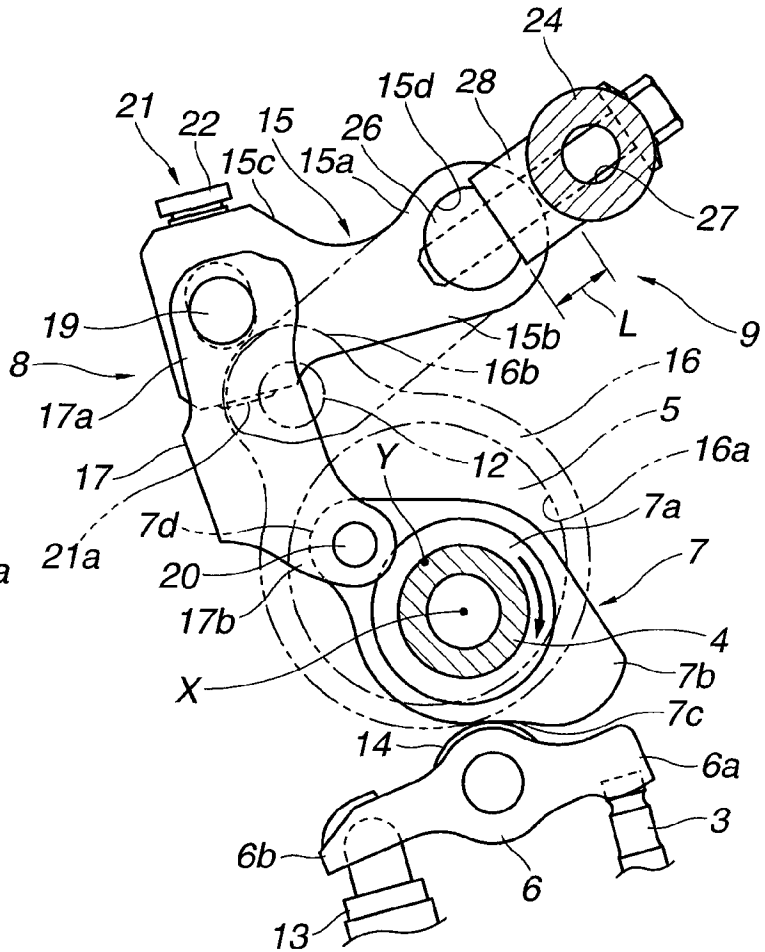
FIGS. 6A and 6B are explanatory views of a movement of the valve control apparatus at the time of minimum lift, in the first embodiment.
Figure 6A:
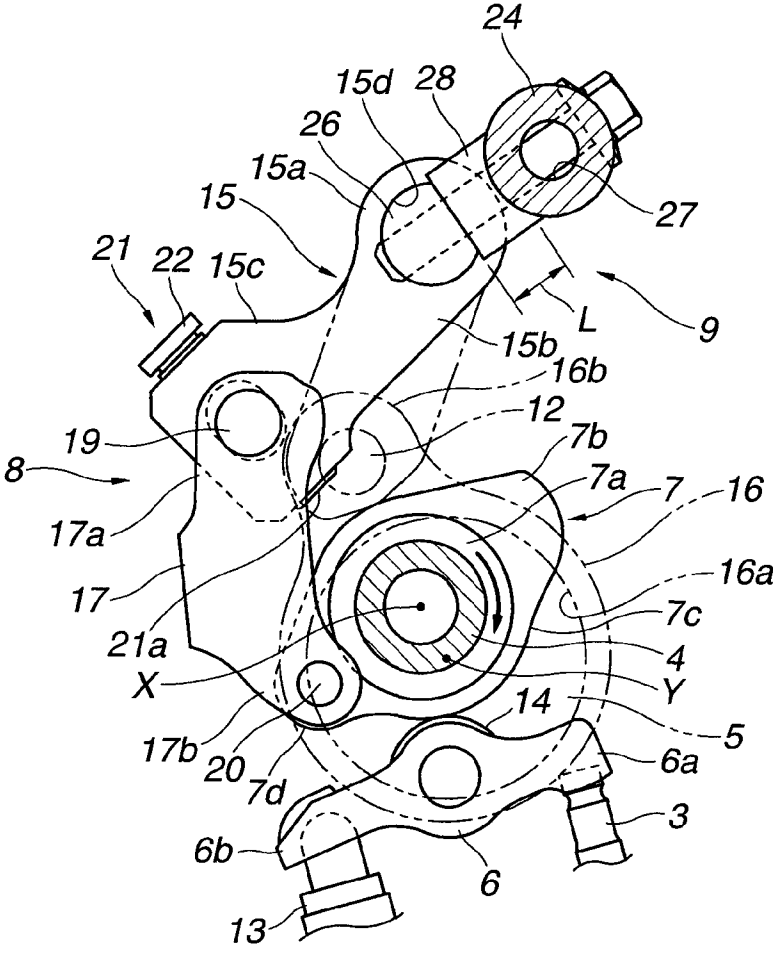

As shown in FIGS. 1, 6A and 6B, a concave lower surface of one end portion 6*a* of each swing arm 6 is in contact with an end of the stem of intake valve 3. On the other hand, a spherical lower surface of another end portion 6*b* of each swing arm 6 is in contact with a spherical head portion of a hydraulic lash adjuster 13, and thereby is supported by the lash adjuster 13. This lash adjuster 13 is held in a retention hole 1*a* formed in the cylinder head 05. Accordingly, each swing arm 6 swings around the head portion of hydraulic lash adjuster 13 by using the head portion of hydraulic lash adjuster 13 as a pivotal fulcrum. Moreover, the swing arm 6 rotatably supports a roller 14 which is in contact with the swing cam 7, at an approximately center portion of swing arm 6 which is formed in a hollow shape.

As shown in FIGS. 1, 6A and 6B, the swing cams 7 and 7 have the shape same as each other. Each swing cam 7 is formed approximately in a raindrop shape. The swing cam 7 is formed integrally with a cam shaft 7*a* provided on a side of base end portion of swing cam 7. The cam shaft 7*a* is formed in a circular-tube shape, and is fitted over the outer circumferential surface of drive shaft 4 by insertion. The swing cam 7 is supported to be able to swing about the shaft center X of drive shaft 4 via the cam shaft 7*a*. That is, the shaft center X serves as a swing axis of the swing cam 7. Moreover, the swing cam 7 includes a cam nose portion 7*b* in a tip side of the swing cam 7. A lower surface of the swing cam 7 as viewed in the axial direction of drive shaft 4 includes a cam surface 7*c* formed between the base end portion of swing cam 7 and the cam nose portion 7*b*. This cam surface 7*c* includes a base circle surface, a ramp surface and a lift surface. The base circle surface is located at a side of the base end portion. The ramp surface extends in a circular-arc shape (in cross section as viewed in the axial direction of drive shaft 4) from the base circle surface toward the cam nose portion 7*b*. The lift surface extends from the ramp surface to a maximum-lift top surface of the cam surface 7*c*. This maximum-lift top surface is located in a tip side of the cam nose portion 7*b*. The base circle surface, the ramp surface, the lift surface or the top surface of the cam surface 7*c* is in contact with the outer circumferential surface of roller 14 of each swing arm 6, in accordance with a swing position of the swing cam 7. That is, a contact point between the cam surface 7*c* and the outer circumferential surface of roller 14 is varied in accordance with the swing position of swing cam 7.

A swinging direction of each swing cam 7 when opening the intake valve 3 (i.e., when the contact point between the cam surface 7*c* and the roller 14 moves toward the lift surface) is identical with a rotational direction of the drive shaft 4 (arrow direction in FIGS. 6A and 6B). Accordingly, a drag torque is applied to the swing cam 7 in the direction that lifts the intake valve 3, because of a friction coefficient between the drive shaft 4 and the swing cam 7. Therefore, a drive efficiency of each swing cam 7 is improved.

Moreover, as shown in FIG. 5, one of the pair of swing cams 7 and 7 which is closer to the drive cam 5 includes a connecting portion 7*d* located on an opposite side of the cam shaft 7*a* from the cam nose portion 7*b*. That is, the cam shaft 7*a* is located between the cam nose portion 7*b* and the connecting portion 7*d*, and this connecting portion 7*d* is formed integrally with the swing cam 7 to protrude from the swing cam 7. The connecting portion 7*d* is formed with a pin hole which passes completely through both lateral surfaces of the connecting portion 7*d*, i.e., which passes through the swing cam 7 in the axial direction of drive shaft 4. A connecting pin 20 for connecting the swing cam 7 with an after-mentioned another end portion of link rod 17 is inserted into the pin hole.

Each roller 14 is arranged to protrude from an upper surface of the corresponding swing arm 6. Hence, a space (clearance) between the upper surface of swing arm 6 and the connecting portion 7*d* of swing cam 7 or between the upper surface of swing arm 6 and the another end portion 17*b* of link rod 17 is given relatively largely, as shown in FIGS. 6A and 6B. Accordingly, an interference between the swing arm 6 and the connecting portion 7*d* of swing cam 7 or the another end portion 17*b* of link rod 17 is prevented during an operation of the valve control apparatus. Therefore, even when the swing cam 7 has been pushed to its maximum degree, the interference between the swing arm 6 and the connecting portion 7*d* of swing cam 7 or the another end portion 17*b* of link rod 17 is avoided.

As shown in FIGS. 1-3, 6A and 6B, the transmission mechanism 8 includes a rocker arm 15, a link arm 16 and the link rod 17. The rocker arm 15 is disposed (to extend) along the width direction of engine above the drive shaft 4. The link arm 16 links the rocker arm 15 with the drive cam 5. The link rod 17 links the rocker arm 15 with the connecting portion 7*d* of the one of swing cam 7. That is, the transmission mechanism 8 is constructed as a multi-joint link mechanism including the rocker arm 15, the link arm 16 and the link rod 17.

Figure 3:
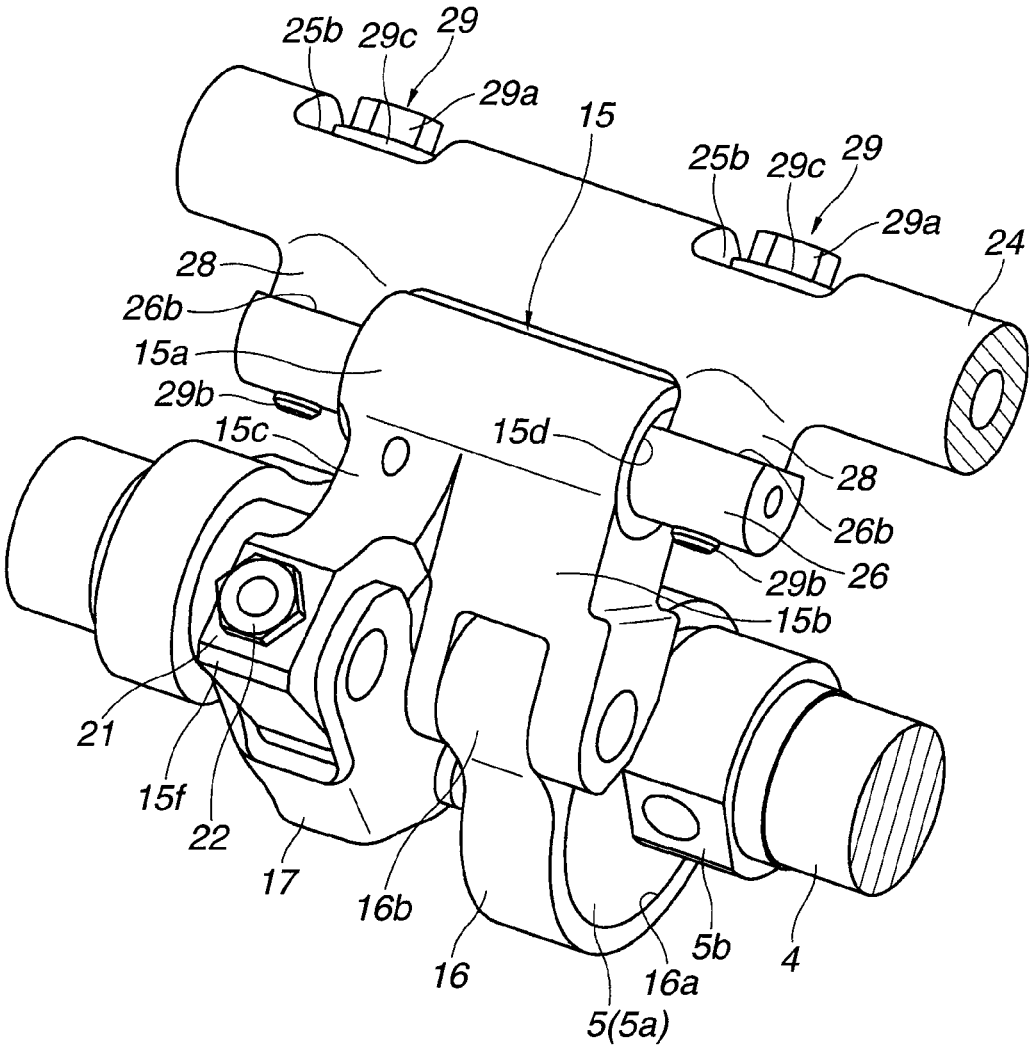
FIG. 3 is an enlarged view of a main part of the valve control apparatus in the first embodiment.

As shown in FIG. 3, the rocker arm 15 includes a tubular base portion 15*a*, a first arm portion 15*b* and a second arm portion 15*c*. The tubular base portion 15*a* is located in one end side of the rocker arm 15, and is swingably supported by an after-mentioned control eccentric shaft 26. The first and second arm portions 15*b* and 15*c* are located in another end side of the rocker arm 15, and are provided to protrude approximately parallel to each other (as viewed in the radial direction of drive shaft 4) from an outer surface of the tubular base portion 15*a* toward an inside of the engine, in a bifurcated manner.

The tubular base portion 15*a* is formed with a support hole 15*d* passing completely through the tubular base portion 15*a* in the axial direction. The tubular base portion 15*a* is supported by causing the support hole 15*d* to be fitted over an after-mentioned outer circumference of the control eccentric shaft 26 through a minute clearance therebetween.

A tip portion of the first arm portion 15*b* is formed in a bifurcated manner. This bifurcated portion is rotatably connected through a connecting pin 12 with an after-mentioned protruding end 16*b* of the link arm 16. That is, the protruding end 16*b* of the link arm 16 is sandwiched between the bifurcated ends of first arm portion 15*b*, to be linked with the rocker arm 15. The connecting pin 12 is prevented from dropping out of (being detached from) a pin hole of the protruding end 16*b*, by a snap ring 12*a* or the like provided at one end portion of the connecting pin 12.

On the other hand, the second arm portion 15*c* includes a block portion 15*f* at a tip portion of second arm portion 15*c*. A lift adjusting mechanism 21 is provided to the block portion 15*f*. An after-mentioned one end portion 17*a* of the link rod 17 is linked rotatably with an after-mentioned pivotally-supporting pin 19 of the lift adjusting mechanism 21. Moreover, the block portion 15*f* is formed with an elongate hole (slot hole, not shown) passing completely through the block portion 15*f* in a lateral direction of the block portion 15*f*. That is, the elongate hole 15*h* is formed to pass from one side of block portion 15*f* to another side of block portion 15*f* in the axial direction of drive shaft 4. The pivotally-supporting pin 19 is capable of moving within the elongate hole in an upper-lower direction, i.e., moving along an elongate shape of the elongate hole, for adjustment.

The first arm portion 15*b* and the second arm portion 15*c* are provided to have angles different from each other in a swinging direction of the rocker arm 15. That is, there is some angle between an imaginary linkage center line of the first arm portion 15*b* and an imaginary linkage center line of the second arm portion 15*c*, in the swinging direction of rocker arm 15 (as viewed in the axial direction of drive shaft 4). Also, the first arm portion 15*b* and the second arm portion 15*c* are positioned to deviate from each other in the upper-lower direction. The tip portion of first arm portion 15*b* is more inclined toward the lower direction by a slight inclination angle than the tip portion of second arm portion 15*c*.

The link arm 16 includes an annular portion (circular tube portion) and the protruding end 16*b*. The annular portion has a relatively large diameter. The protruding end 16*b* is provided to protrude from a predetermined portion of outer circumferential surface of the annular portion. A fitting hole 16*a* is formed at a center portion of the annular portion. The fitting hole 16*a* is fitted over an outer circumferential surface of the drive cam 5 so that the drive cam 5 rotatably supports the link arm 16.

As shown in FIG. 5, the link rod 17 includes both rod portions located away from each other in the axial direction of drive shaft 4. These two rod portions are integrally formed by press molding. Hence, the link rod 17 is shaped like a U-shape in cross section. In order to attain a compactification inside the link rod 17, the link rod 17 is formed by being bent in an approximately circular-arc shape. The one end portion 17*a* of link rod 17 is connected with the tip portion of second arm portion 15*c* through the pivotally-supporting pin 19 inserted into a pin hole of the one end portion 17*a*. The another end portion 17*b* of link rod 17 is connected rotatably with the connecting portion 7*d* of swing cam 7 through the connecting pin 20 inserted into a pin hole of the another end portion 17*b*. This connecting pin 20 includes a flange 20*a* in one end side of the connecting pin 20. Since the flange 20*a* is appropriately in contact with an outer circumferential edge of the spacer 2, the connecting pin 20 is prevented from being detached from the pin hole of another end portion 17*b*.

Moreover, since only one link rod 17 is provided to each cylinder of the engine, a structure of the valve control apparatus can be simplified while lightening a weight of the apparatus.

The swing cam 7 swings to lift the intake valve 3 when the link rod 17 raises (pulls up) the connecting portion 7*d*. Since the cam nose portion 7*b* that receives an input from the roller 14 is located on the opposite side of a swinging center of swing cam 7 from the connecting portion 7*d*, a generation of fall (inclination) of the swing cam 7 can be suppressed.

As shown in FIG. 5, the lift adjusting mechanism 21 includes the pivotally-supporting pin 19, an adjusting bolt 21*a*, and a lock bolt 22. The pivotally-supporting pin 19 is provided in the elongate hole of block portion 15*f* of second arm portion 15*c* of rocker arm 15. The adjusting bolt 21*a* is screwed into an adjusting female threaded hole from its lower side. This adjusting female threaded hole is drilled in a lower portion of the block portion 15*f* toward the elongate hole. Moreover, a fixing female threaded hole (not shown) is drilled in an upper portion of the block portion 15*f* toward the elongate hole. The lock bolt 22 is screwed into the fixing female threaded hole from its upper side.

After an assembling of the respective structural elements, a length between the second arm portion 15*c* of rocker arm 15 and the one end portion 17*a* of link rod 17 (i.e., a location of connection point between the second arm portion 15*c* and the one end portion 17*a*) is adjusted by adjusting an up-down position of the pivotally-supporting pin 19 within the elongate hole (i.e., by adjusting a position of pin 19 set along the elongate shape of elongate hole) by use of the adjusting bolt 21*a*. Thereby, a fine adjustment for the lift amount of each intake valve 3 is carried out. After this fine adjustment, the position of pivotally-supporting pin 19 is fastened by tightening the lock bolt 22.

As shown in FIGS. 1 to 5, the control mechanism 9 includes a control shaft 24 and an actuator 31. The control shaft 24 is disposed parallel to the drive shaft 4, in a region above the drive shaft 4. The actuator 31 functions to drive a rotation of the control shaft 24.

Figure 4:
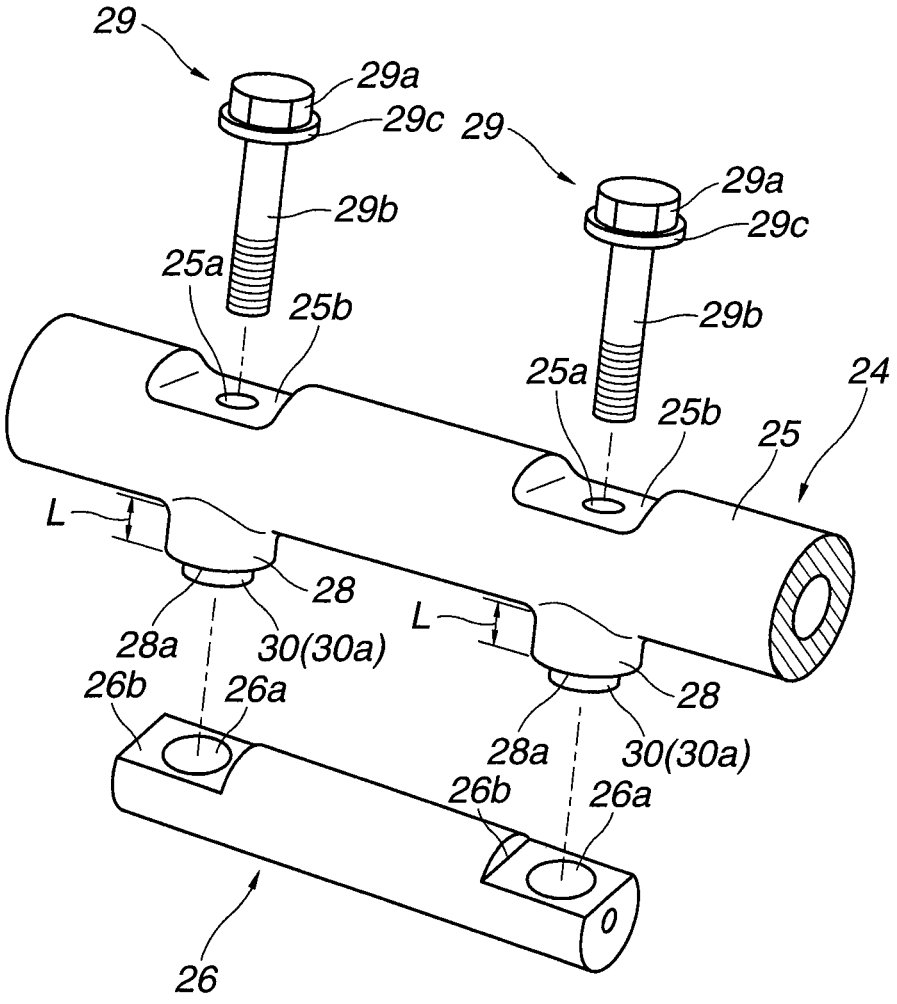
FIG. 4 is an oblique perspective view showing a control shaft provided to the valve control apparatus in the first embodiment.

As shown in FIGS. 4 and 5, the control shaft 24 mainly includes a control shaft main body 25 and a control eccentric shaft 26. The control shaft main body 25 is formed in an internally hollow shape. The control eccentric shaft 26 is disposed laterally adjacent to the control shaft main body 25, and extends in an axial direction of the control shaft main body 25 (=axial direction of the drive shaft 4). The control eccentric shaft 26 is fixed to the control shaft main body 25 by means of a pair of bolts 29 and 29. Each bolt 29 is a commonly-used bolt including a head portion 29*a*, a shaft portion 29*b*, and a seat portion 29*c*. The head portion 29*a* is formed in a hexagon shape. The shaft portion 29*b* is formed integrally with the head portion 29*a*. The shaft portion 29*b* includes a male threaded portion in an outer circumference of tip side of the shaft portion 29*b*. The seat portion 29*c* is formed in a flange shape, and is provided integrally with a root portion of the head portion 29*a* which is located on a side of the shaft portion 29*b*.

As shown in FIGS. 4 and 5, the control shaft main body 25 is formed with an oil supplying hole 27, inside the control shaft main body 25. The oil supplying hole 27 extends along a shaft center of control shaft main body 25, i.e., extends in the axial direction, inside the control shaft main body 25. This oil supplying hole 27 is an after-mentioned first lubricating-oil passage. The control shaft main body 25 includes a pair of first protruding portions 28 and 28 each of which protrudes from an outer circumferential surface of the control shaft main body 25 in a radial direction of the control shaft main body 25. These first protruding portions 28 and 28 are formed at a location corresponding to the location of each cylinder.

Each first protruding portion 28 is formed in a cylindrical tube shape. The first protruding portions 28 and 28 are provided integrally with the control shaft main body 25 to have a predetermined interval (distance) between the both first protruding portions 28 and 28 in the axial direction of control shaft main body 25. A protrusion length L of one of these first protruding portions 28 and 28 is equal to a protrusion length L of another of these first protruding portions 28 and 28. Each of top surfaces (tip surfaces) 28*a* and 28*a* of the first protruding portions 28 and 28 is formed to be flat perpendicularly to a protruding direction of first protruding portion 28. The protrusion length L of first protruding portion 28 mainly determines an eccentric amount a between the shaft center P of the control shaft main body 25 and a shaft center P1 of the control eccentric shaft 26, i.e., determines an eccentricity of the control eccentric shaft 26 relative to a rotation center of the control shaft main body 25. This protrusion length L is freely designed according to specifications and size of vehicle and the like.

Moreover, the control shaft main body 25 is formed with a pair of bolt insertion holes 25*a* and 25*a* each of which completely passes through the control shaft main body 25 along a diameter of the control shaft main body 25 (in the radial direction of control shaft main body 25). The pair of bolt insertion holes 25*a* and 25*a* are provided at locations corresponding to the locations of first protruding portions 28 and 28. Each bolt insertion hole 25*a* is formed to pass through the control shaft main body 25 in the radial direction and to continuously pass through the first protruding portion 28 along a shaft center of the first protruding portion 28. The shaft portions 29*b* and 29*b* of pair of bolts 29 and 29 are respectively inserted into the bolt insertion holes 25*a* and 25*a*, and pass through the bolt insertion holes 25*a* and 25*a*.

The control shaft main body 25 is formed with a pair of first cutout surfaces 25*b* and 25*b*, at hole edges of the bolt insertion holes 25*a* and 25*a* which are located on a side of the head portion 29*a*. Each first cutout surface 25*b* has a flat rectangular bottom surface perpendicular to an axis of the bolt insertion hole 25*a*, and is formed in a concave groove shape in a cross section taken parallel to the axial direction of control shaft main body 25 and the axial direction of shaft portion 29*b*. Each first cutout surface 25*b* functions as a seat surface on which the seat portion 29*c* of bolt 29 is seated.

The control eccentric shaft 26 rotatably supports the tubular base portion 15*a* of rocker arm 15. The control eccentric shaft 26 is formed in a rod shape having its axial length approximately equal to a length (distance) between the pair of first protruding portions 28 and 28. Both end portions of the control eccentric shaft 26 are formed with a pair of female threaded holes 26*a* and 26*a* each of which passes completely through the control eccentric shaft 26 in the radial direction of control eccentric shaft 26. Each of the pair of female threaded holes 26*a* and 26*a* is a fixing hole into which the male threaded portion of the tip portion of shaft portion 29*b* of bolt 29 is screwed. The control eccentric shaft 26 is formed with a pair of second cutout surfaces 26*b* and 26*b*. Each of the pair of second cutout surfaces 26*b* and 26*b* is formed at an outer circumferential surface of one hole-edge side of the female threaded hole 26*a*. Each second cutout surface 26*b* has a flat rectangular bottom surface perpendicular to an axis of the female threaded hole 26*a*, and is formed in a concave groove shape in a cross section taken parallel to the axial direction of control eccentric shaft 26 and the axial direction of shaft portion 29*b* of bolt 19. Each second cutout surface 26*b* is in contact with the top surface 28*a* of first protruding portion 28. According to this embodiment, each female threaded hole 26*a* does not necessarily need to pass completely through the control eccentric shaft 26.

Moreover, a tip portion of each first protruding portion 28, i.e., a tip portion of each bolt insertion hole 25*a* is formed with a cylindrical groove having a diameter approximately equal to a diameter of a cylindrical groove formed at a tip portion of each female threaded hole 26*a* of control eccentric shaft 26 which is located on the side of first protruding portion 28. The cylindrical groove of first protruding portion 28 and the cylindrical groove of control eccentric shaft 26 are formed to be continuous with each other while facing each other. A collar 30 which is a tubular positioning member is disposed inside the cylindrical grooves of the first protruding portion 28 and the control eccentric shaft 26. That is, a pair of collars 30 and 30 are provided respectively to both end portions of the control eccentric shaft 26. As shown in FIG. 4, when the control eccentric shaft 26 is attached to the control shaft main body 25 through the respective first protruding portions 28 and 28, an approximately half of each collar 30 relative to an axial direction of collar 30 has been fitted into the cylindrical groove of first protruding portion 28 by press fitting in advance. Then, a protruding part 30*a* of each collar 30 (a part not-fitted into the cylindrical groove of first protruding portion 28) is fitted into the cylindrical groove of control eccentric shaft 26, so that a positioning between the control shaft main body 25 and the control eccentric shaft 26 is carried out. As a result, the collar 30 is arranged so as to straddle a boundary between the cylindrical groove of control eccentric shaft 26 and the cylindrical groove of first protruding portion 28.

Moreover, an annular passage 34 is formed between an outer circumferential surface of the shaft portion 29*b* of bolt 29 and an inner circumferential surface of bolt insertion hole 25*a* of one of the pair of first protruding portions 28 and 28 and also between the outer circumferential surface of shaft portion 29*b* and an inner circumferential surface of the collar 30. This annular passage 34 communicates with the oil supplying hole 27. That is, the annular passage 34 is a second lubricating-oil passage which communicates with the first lubricating-oil passage (oil supplying hole 27) and which is open to the outer circumferential surface of control shaft main body 25. An oil passage hole 35 communicating with the annular passage 34 is formed inside the control eccentric shaft 26, as shown in FIG. 5. This oil passage hole 35 is formed substantially in a T shape in a cross section taken parallel to the axial direction of control eccentric shaft 26. The oil passage hole 35 is a third lubricating-oil passage which communicates with the second lubricating-oil passage (annular passage 34).

An upstream end of the oil supplying hole 27 communicates with a main oil gallery (not shown) for supplying lubricating oil to sliding portions of the engine and the like. An upstream end of the annular passage 34 is open to the oil supplying hole 27, and a downstream end of the annular passage 34 is open to an upstream end of the oil passage hole 35.

The oil passage hole 35 includes an axial hole 35*a* and a branch hole 35*b*. The axial hole 35*a* is formed inside the control eccentric shaft 26 to extend in the axial direction of control eccentric shaft 26. The branch hole 35*b* branches off or arises from a downstream end of the axial hole 35*a*, and extends from the downstream end of axial hole 35*a* in a radial direction of the control eccentric shaft 26. An edge of upstream end of the axial hole 35*a* is blocked (closed) by a ball plug 36. On the other hand, both ends of the branch hole 35*b* are open to an annular groove 15*e*. This annular groove 15*e* is formed in an inner circumferential surface of the support hole 15*d* of tubular base portion 15*a*.

Figure 2:
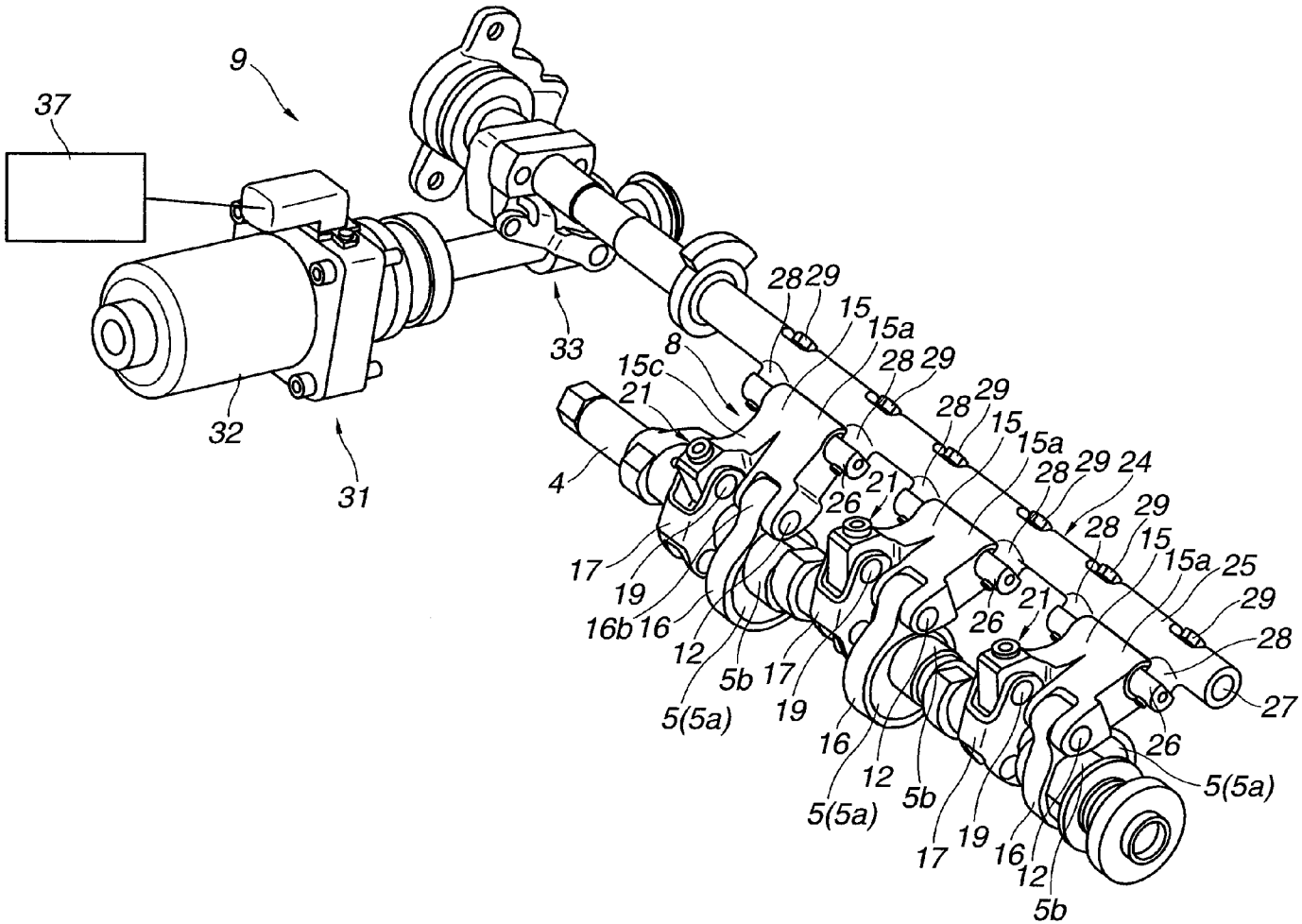
FIG. 2 is an oblique perspective view of a valve control apparatus in a first embodiment according to the present invention.

As shown in FIG. 2, the actuator 31 includes an electric motor 32 and a ball screw mechanism 33. The electric motor 32 is fixed to a rear end portion of the cylinder head 05. The ball screw mechanism 33 is a speed reducer for transmitting a rotational drive force of the electric motor 32 to the control shaft 24.

The electric motor 32 is constructed by a proportional DC motor. This electric motor 32 is driven by control signals that are outputted from an electronic controller 37 configured to detect the operating state of engine. The electronic controller 37 detects the current operating state of engine, e.g., by calculations using detection signals derived from a crank angle sensor for sensing an engine rotational speed, an air flow meter for sensing an amount of intake air, a water-temperature sensor for sensing a water temperature of the engine or the like. Moreover, the electronic controller 37 receives signals from a potentiometer for sensing a rotational position of the control shaft 24, and the like. Thereby, the electronic controller 37 controls the electric motor 32 by way of feedback control. Since the rotation of actuator 31 is driven by such an electric motor 32, a prompt responsivity in change can be obtained irrespective of oil temperature of engine and the like.

The actuator 31 controls the control eccentric shaft 26 through the control shaft main body 25, to cause the control eccentric shaft 26 to rotate in forward and reverse directions. By this rotational position of the control eccentric shaft 26, the valve lift amount (i.e., the lift-amount characteristic and working angle) of intake valve 3 is controlled through the transmission mechanism 8 and the like, from a minute lift to a maximum lift.

Operations of the valve control apparatus according to the first embodiment will now be explained.

For example, at the time of low-speed operation of the engine (in a low-speed operation region of engine) such as at the time of engine idling, the electric motor 32 is driven (rotated) by control signals derived from the electronic controller 37. This rotational torque of the electric motor 32 rotates the control shaft 24 up to a predetermined rotational position in a counterclockwise direction by the ball screw mechanism 33, for example as shown in FIGS. 6A and 6B. Hence, the control eccentric shaft 26 rotates similarly (by the same angle), i.e., moves slightly in a lower direction of the control shaft 24 in FIGS. 6A and 6B. Thereby, whole of the transmission mechanism 8 is tilted around the drive shaft 4 in the counterclockwise direction. Hence, also each swing cam 7 rotates in the counterclockwise direction so that a base-circle-surface side of the cam surface 7*c* becomes in contact with the roller 14 of swing arm 6.

When the rocker arm 15 is raised upwardly by the link arm 16 in response to the rotation of drive cam 5 from the state shown by FIG. 6A, the connecting portion 7*d* of swing cam 7 is lifted upwardly by the link rod 17 to rotate the swing cam 7 in the clockwise direction, as shown in FIG. 6B. This lift is transmitted to the roller 14 of swing arm 6. Accordingly, the intake valve 3 is lifted. However, at this time, both of the lift amount and working angle of intake valve 3 are sufficiently small. That is, minute lift and minute working angle of each intake valve 3 are achieved.

Thus, in this operating region of engine (low-speed and low-load region), the valve lift amount (lift-amount characteristic) of each intake valve 3 is sufficiently small. Therefore, an opening timing of each intake valve 3 is delayed so that a valve overlap between the intake valve 3 and an exhaust valve is avoided. Hence, an improvement of combustion and the like can be obtained to attain an enhancement of fuel economy and a stable rotation of the engine.

Next, when the state of engine changes to a low-and-middle-speed and middle-load region, the control shaft 24 is rotated further in the counterclockwise direction from the state shown in FIG. 6A by the electric motor 32 driven by the electronic controller 37. Hence, also the control eccentric shaft 26 rotates by the same angle as the control shaft 24, i.e., approaches the drive shaft 4.

Thereby, whole of the transmission mechanism 8 including the rocker arm 15 and the link arm 16 is tilted around the drive shaft 4 in the clockwise direction. Hence, also each swing cam 7 rotates relatively in the clockwise direction (lift direction).

Accordingly, at the time of peak lift which is produced because of the rotation of drive cam 5, a lift of the swing cam 7 is transmitted to the roller 14 of swing arm 6 so that the intake valve 3 is lifted. At this time, both of the lift amount and working angle of intake valve 3 are larger than those of the low-speed operation region. That is, middle lift and middle working angle of each intake valve 3 are achieved.

Thus, in this operating region of engine, the valve lift amount (characteristic) and the working angle of each intake valve 3 are relatively large. Therefore, the improvement of fuel economy and an enhancement of engine torque can be achieved.

Figure 7B:
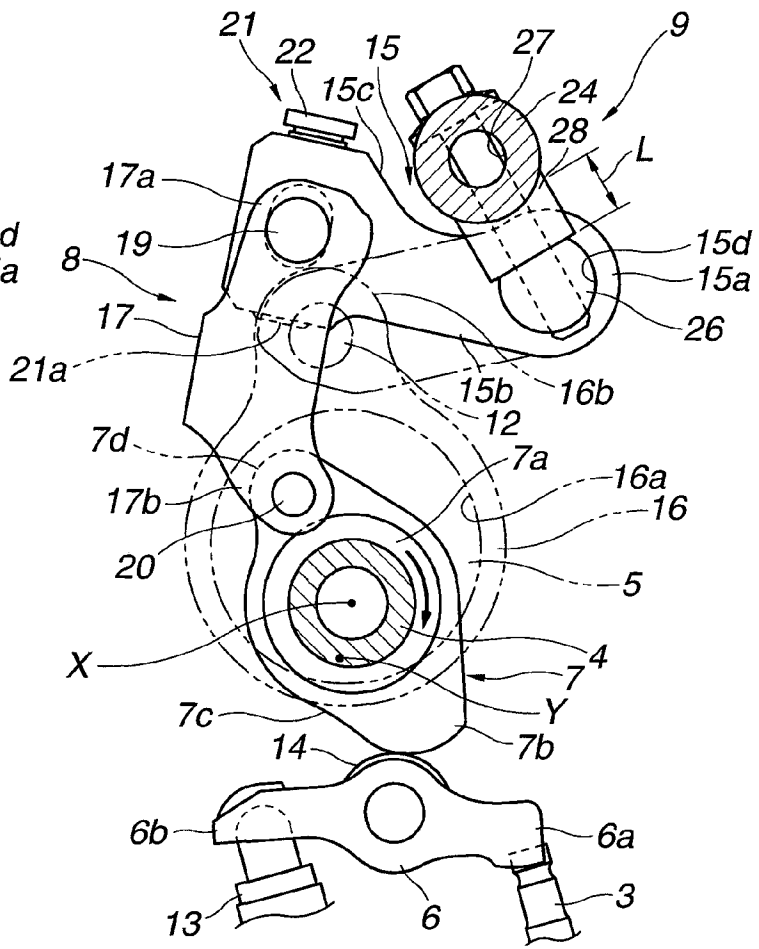
FIGS. 7A and 7B are explanatory views of the movement of the valve control apparatus at the time of maximum lift, in the first embodiment.
Figure 7A:
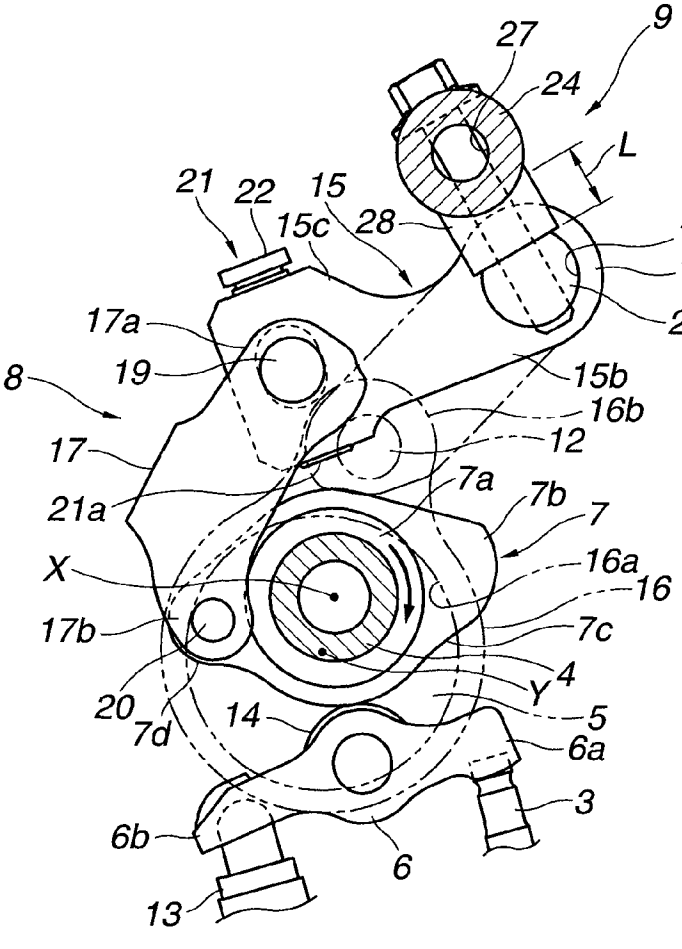

Next, when the state of engine changes to a high-speed and high-load region, the control shaft 24 is rotated further in the counterclockwise direction, by the ball screw mechanism 33 driven by the electric motor 32 controlled by the electronic controller 37. Thereby, as shown in FIGS. 7A and 7B, the control eccentric shaft 26 rotates in the same direction as the control shaft 24 so that the control eccentric shaft 26 moves to its position closest to the drive shaft 4.

Thereby, whole of the transmission mechanism 8 including the rocker arm 15 and the link arm 16 is further tilted around the drive shaft 4 in the clockwise direction. Hence, also each swing cam 7 rotates further in the clockwise direction (lift direction). Accordingly, at the time of peak lift which is produced by the rotation of drive cam 5, a lift of the swing cam 7 is transmitted to the roller 14 of swing arm 6 so that the intake valve 3 is lifted. At this time, both of the lift amount and working angle of intake so valve 3 are larger than those of the low-and-middle-speed and middle-load region. That is, maximum lift and maximum working angle of each intake valve 3 are achieved.

Thus, in this operating region of engine, the is valve lift amount (characteristic) and the working angle of each intake valve 3 are maximized. Therefore, the valve overlap between the intake valve 3 and the exhaust valve is increased, and a closing timing of each intake valve 3 is sufficiently delayed. As a result, an intake-air charging efficiency is enhanced so that a sufficient output power of engine can be secured.

According to this first embodiment, the control eccentric shaft 26 can be attached and fixed to the respective protruding portions 28 and 28 of control shaft main body 25 in the radial direction, by using the bolts 29 and 29. Accordingly, a process (installation work) for this attachment is very easy. Hence, whole structure of the valve control apparatus can be simplified so that a manufacturing operation becomes simple. Therefore, a cost reduction can be achieved.

Moreover, according to the first embodiment, as mentioned above, the control shaft 24 can be formed in a crank shape which produces the large eccentric amount $\alpha$, by attaching the control eccentric shaft 26 to the control shaft main body 25. Accordingly, it is not necessary to form (assemble) the rocker arm 15 from some divided pieces given for the rocker arm, as disclosed in the technique other than the present application. Hence, in this embodiment, an increase of weight of the valve control apparatus is suppressed to achieve a reduction in size and weight. Thus, since the sufficient weight reduction of the valve control apparatus can be attained, a drivability (operability) of the engine becomes preferable in the high-speed region of engine. Furthermore, since the size reduction can be attained, a mounting performance of apparatus to an inside of engine compartment becomes preferable to improve a flexibility of layout.

Moreover, according to the first embodiment, the head portion 29*a* of each bolt 29 is in contact with the first cutout surface 25*b* of control shaft main body 25 under the state where the head portion 29*a* has been fitted into the concave groove shaped by forming the first cutout surface 25*b*. Accordingly, an amount by which the head portion 29*a* protrudes from (an outer circumferential surface of) the control shaft main body 25 is small. Hence, also from this point of view, the downsizing of valve control apparatus can be enhanced so that the mounting performance of apparatus to the engine compartment is greatly improved. Since the seat portion 29*c* of head portion 29*a* abuts on a part of the first cutout surface 25*b* which is formed as the bottom of concave groove, the downsizing of valve control apparatus can be further enhanced.

Moreover, according to the first embodiment, the lubricating oil supplied to the oil supplying hole 27 is forcibly supplied through the annular passage 34 and the oil passage hole 35 to the annular groove 15*e*. Accordingly, a sufficient lubrication can be performed for a sliding portion between the outer circumferential surface of control eccentric shaft 26 and the support hole 15*d* of tubular base portion 15*a* of rocker arm 15. As a result, the rocker arm 15 can be smoothly swung at all times.

Moreover, according to the first embodiment, a means for performing the lubrication between the control eccentric shaft 26 and the tubular base portion 15*a* is formed by using inside portions of the protruding portion 28 and the control eccentric shaft 26. Accordingly, a simplification of the lubricating means can be achieved. Also from this point of view, the manufacturing operation becomes easy.

Moreover, according to the first embodiment, the control eccentric shaft 26 is tightened and fixed to the control shaft main body 25 by the pair of bolts 29 and 29 under the state where the top surfaces 28*a* and 28*a* of protruding portions 28 and 28 of control shaft main body 25 respectively abut on the pair of second cutout surfaces 26*b* and 26*b* of control eccentric shaft 26. Hence, a press-contact force between each second cutout surface 26*b* and the corresponding top surface 28*a* is strong, so that a sufficient adhesiveness (i.e., sufficient sealing performance) can be obtained. Therefore, a leakage of lubricating oil from a portion between the annular passage 34 and the oil passage hole 35 can be sufficiently suppressed.

Moreover, according to the first embodiment, the seat portions 29*c* and 29*c* of the pair of bolts 29 and 29 are stably seated on (mounted in contact with) the first cutout surfaces 25*b* and 25*b* of control shaft main body 25. Accordingly, an axial force of each bolt 29 can be enhanced, so that an mounting strength of the control eccentric shaft 26 can be high.

Moreover, according to the first embodiment, the positioning for the control eccentric shaft 26 relative to the protruding portions 28 and 28 is easy because of the usage of pair of collars 30 and 30. Hence, an mounting operation of the control eccentric shaft 26 is easy.

[Second Embodiment]

Figure 8:
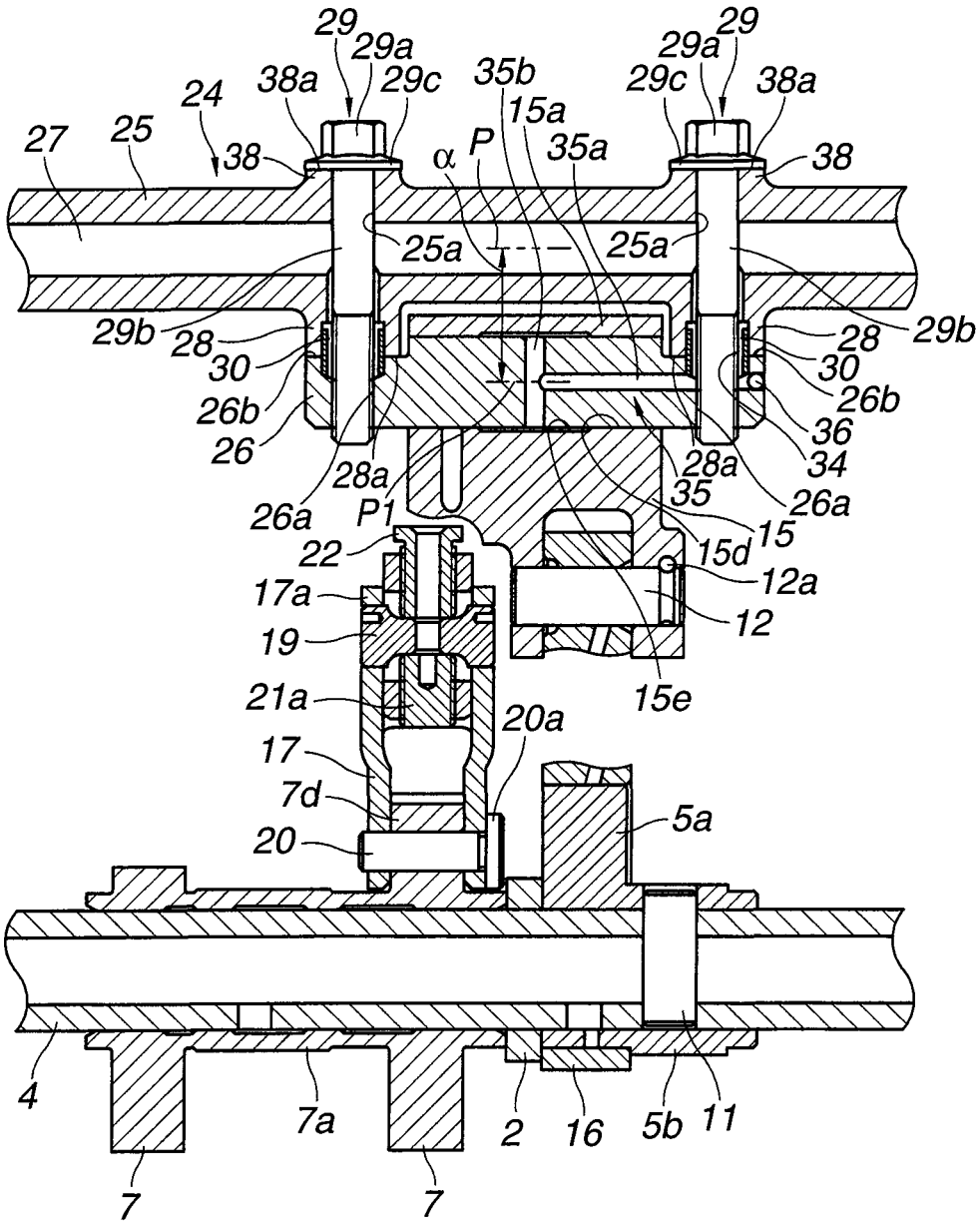
FIG. 8 is a longitudinally-cross-sectional view of main part of a valve control apparatus in a second embodiment according to the present invention.

FIG. 8 is a cross sectional view showing a structure according to a second embodiment of the present invention. A basic structure according to the second embodiment is approximately same as that of the first embodiment. As a structure different from the first embodiment, a pair of boss portions 38 and 38 are provided, instead of the pair of first cutout surfaces 25*b* and 25*b* of control shaft main body 25 of the first embodiment. Structural elements in the second embodiment which are common to the first embodiment are given the same reference signs as the first embodiment, and concrete explanations thereof will be omitted for the purpose of simplification of the disclosure.

The both boss portions 38 and 38 are located on an radially opposite side of the control shaft main body 25 from the protruding portions 28 and 28, namely are provided along diameter lines of control shaft main body 25 which pass through the protruding portions 28 and 28. That is, each of the boss portions 38 and 38 is provided along the center axis of the protruding portion 28. Each of the boss portions 38 and 38 is formed integrally with the control shaft main body 25, and is formed in an approximately cylindrical shape in the same manner as the protruding portion 28. Moreover, each of the boss portions 38 and 38 is formed with the bolt insertion hole 25*a* which passes completely through the boss portion 38 in an axial direction of the boss portion 38 (=the axial direction of bolt insertion hole 25*a*), in the same manner as the protruding portion 28. An top surface (outer end surface) 38*a* of each boss portion 38 is formed to be a flat surface perpendicular to the axial direction of bolt insertion hole 25*a*. The seat portion 29*c* of each bolt 29 is seated on this top surface 38*a*.

In the second embodiment, each of the pair of bolts 29 and 29 is longer than that of the first embodiment, by an axial length of the boss portion 38.

Therefore, according to the second embodiment, the respective boss portions 38 and 38 are provided instead of the first cutout surfaces 25*b* and 25*b*. Accordingly, a rigidity of the control shaft main body 25 is sufficiently enhanced as compared with the structure of the first embodiment.

Hence, a torsional deformation and a bending deformation of the control shaft main body 25 are suppressed during the rotation of control shaft main body 25. Moreover, since a tightening force of each bolt 29 can be enlarged, the axial force of each bolt 29 is increased to further enhance the mounting strength and the sealing performance of the control eccentric shaft 26. The other advantageous effects are same as the first embodiment.

[Third Embodiment]

Figure 9:
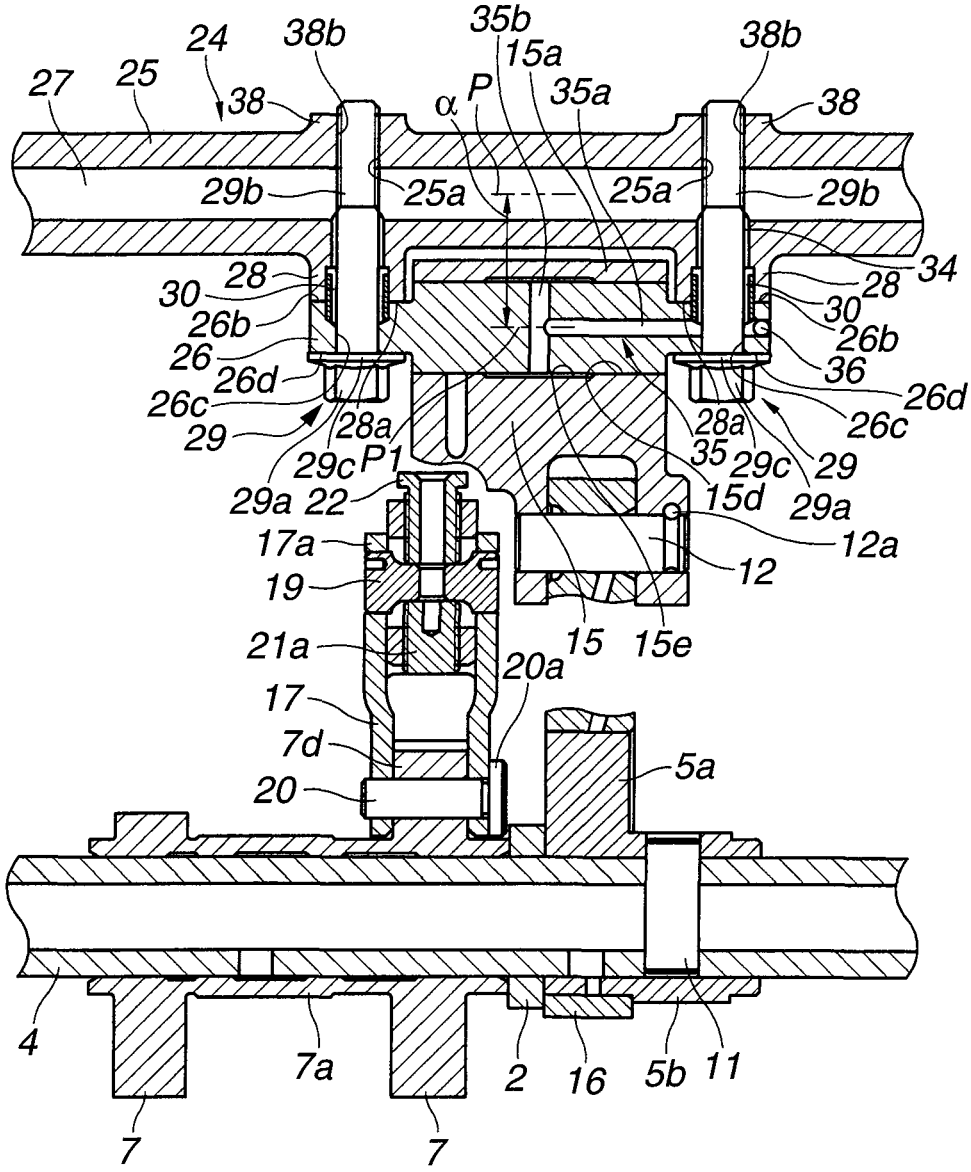
FIG. 9 is a longitudinally-cross-sectional view of main part of a valve control apparatus in a third embodiment according to the present invention.

FIG. 9 is a cross sectional view showing a structure according to a third embodiment of the present invention. In the third embodiment, the pair of bolts 29 and 29 are inserted into and fixed to the control shaft main body 25 from a side of the control eccentric shaft 26.

The pair of boss portions 38 and 38 are provided to the control shaft main body 25 in the same manner as the second embodiment. A female threaded hole 38*b* is formed in each boss portion 38 and in a portion of the control shaft main body 25 which is located on the boss portion 38, in an axial direction of the boss portion 38 (i.e., perpendicularly to the axial direction of control shaft main body 25). Each female threaded hole 38*b* is formed to be continuous with the bolt insertion hole 25*a*, and passes completely through the boss portion 38. This female threaded hole 38*b* functions as a fixing hole for the bolt 29. Moreover, the bolt insertion hole 25*a* is formed in each protruding portion 28 in the axial direction of the protruding portion 28, to pass completely through the protruding portion 28. It is noted that the respective female threaded holes 38*b* and 38*b* do not necessarily need to pass completely through the boss portions 38 and 38.

On the other hand, bolt insertion holes 26*c* and 26*c* are formed in both end portions of the control eccentric shaft 26 in the diameter direction (radial direction) of control eccentric shaft 26, instead of the female threaded holes 26*a* and 26*a* of the first embodiment. Each of the bolt insertion holes 26*c* and 26*c* passes completely through the control eccentric shaft 26. Each of the both end so portions of control eccentric shaft 26 includes a third cutout surface 26*d* formed in an opposite side of the control eccentric shaft 26 from the control shaft main body 25 (i.e., in a lower side of the end portion of control eccentric shaft 26 in FIG. 9). Each third cutout surface 26*d* is formed in a rectangular flat shape. The seat portion 29*c* of bolt 29 is seated on this third cutout surface 26*d*. The other structures in the third embodiment are similar as the first embodiment. Hence, the structures similar as the first embodiment are given the same reference signs as the first embodiment, and explanations thereof will be omitted for the purpose of simplification of the disclosure.

According to the third embodiment, the control eccentric shaft 26 is attached to the control shaft main body 25 by passing the pair of bolts 29 and 29 from the side of drive shaft 4 through the bolt insertion holes 26*c* and 26*c* of control eccentric shaft 26 and then by screwing the bolts 29 and 29 into the female threaded holes 38*b* and 38*b* of control shaft main body 25. Accordingly, the head portion 29*a* of each bolt 29 does not largely project from the control shaft main body 25. As a result, a sufficient axial force of each bolt 29 can be obtained while attaining a downsizing of the valve control apparatus in the radial direction. The other advantageous effects are same as the first embodiment.

[Fourth Embodiment]

Figure 10:
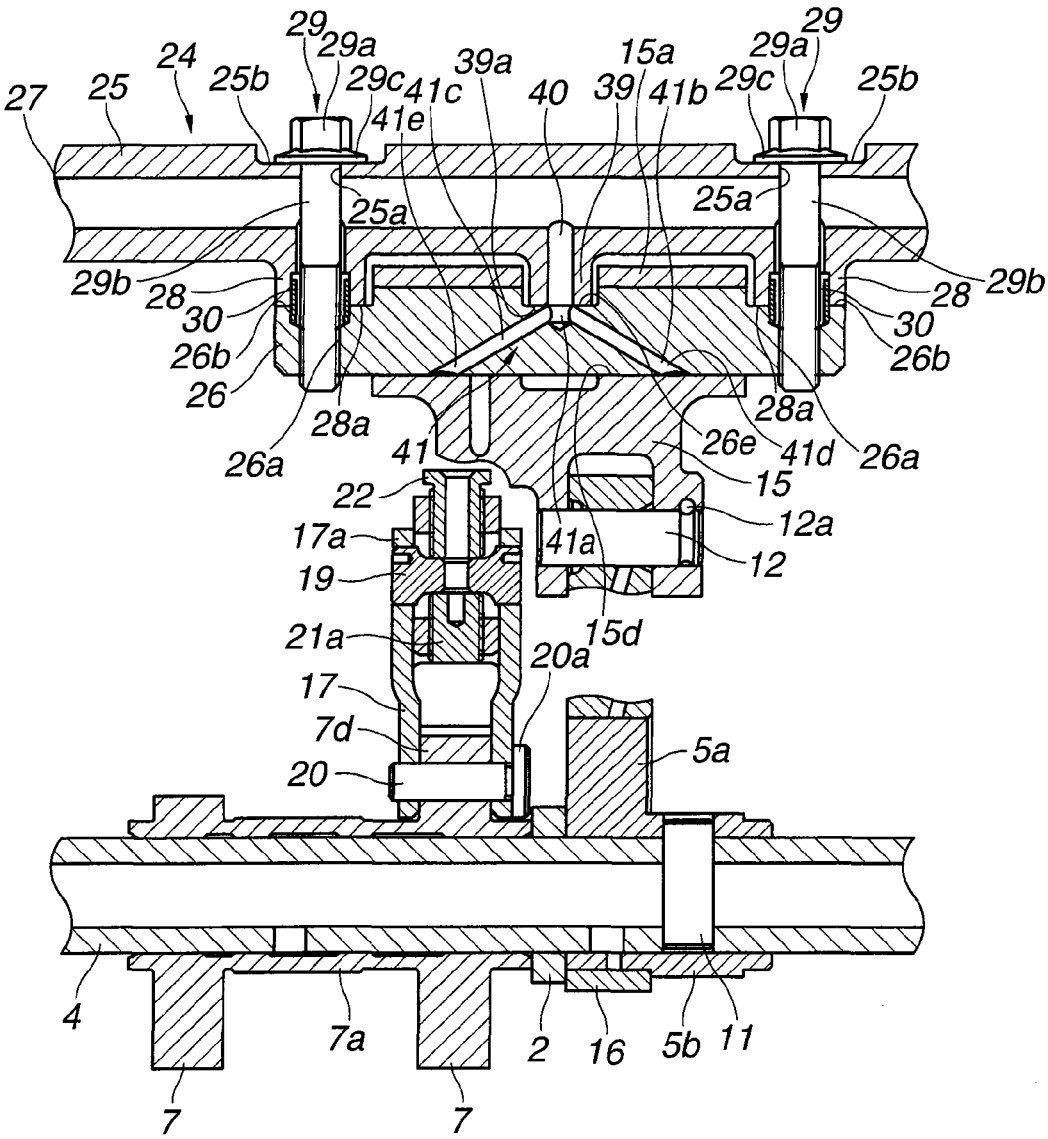
FIG. 10 is a longitudinally-cross-sectional view of main part of a valve control apparatus in a fourth embodiment according to the present invention.

FIG. 10 is a cross sectional view showing a structure according to a fourth embodiment of the present invention. In the fourth embodiment, the tubular base portion 15*a* of rocker arm 15 is formed to have its axial length slightly longer than that of the first to third embodiments, and is formed in a bifurcated manner. Moreover, in this fourth embodiment, the structures of the second and third lubricating-oil passages are different from those of the first to third embodiments.

A third protruding portion 39 is further provided integrally with the control shaft main body 25, at a center portion between the pair of protruding portions 28 and 28 of control shaft main body 25. As shown in FIG. 10, the third protruding portion 39 protrudes from the outer circumferential surface of control shaft main body 25 in the radial direction, in the same manner as the protruding portions 28 and 28. In this fourth embodiment, these two protruding portions 28 and 28 are formed to have a span (distance) therebetween which is longer than that in the first to third embodiments.

An outer diameter of the third protruding portion 39 is slightly smaller than those of the protruding portions 28 and 28. The third protruding portion 39 is formed with an oil hole 40 which passes completely through the third protruding portion 39 in the radial direction of control shaft main body 25 (i.e., in an axial direction of third protruding portion 39). The oil hole 40 functions as the second lubricating-oil passage which communicates with the first lubricating-oil passage (oil supplying hole 27). Moreover, a top surface (tip surface) 39*a* of the third protruding portion 39 is formed as a flat surface perpendicular to the axial direction of third protruding portion 39.

On the other hand, a fitting groove 26*e* is formed in the outer circumferential surface of the control eccentric shaft 26, and is located at an approximately center of the control eccentric shaft 26 relative to the axial direction of control eccentric shaft 26. The fitting groove 26*e* has a flat bottom surface which is in contact with the third protruding portion 39. That is, the top surface 39*a* of third protruding portion 39 is in press-contact with the bottom surface of fitting groove 26*e* by the tightening force of bolts 29 and 29. The control eccentric shaft 26 is formed to have a relatively long length in conformity with the relatively long span between the protruding portions 28 and 28. The control eccentric shaft 26 is formed with an oil passage hole 41 located in an approximately center portion of the control eccentric shaft 26 relative to the axial direction of control eccentric shaft 26. The oil passage hole 41 functions as the third lubricating-oil passage.

The oil passage hole 41 includes a large-diameter hole 41*a* and branch holes 41*b* and 41*c*. The large-diameter hole 41*a* is located at a center of the control eccentric shaft 26 relative to the axial direction of control eccentric shaft 26, and is formed to be drilled into the control eccentric shaft 26 in the radial direction of control eccentric shaft 26. The branch holes 41*b* and 41*c* are formed to branch off (arise) from a downstream end of the large-diameter hole 41*a*, and extend from the downstream end of large-diameter hole 41*a* in an inverted-V shape in a cross section taken by a plane including the shaft center of control shaft main body 25. The large-diameter hole 41*a* is formed to have a short length in the axial direction of control eccentric shaft 26, and communicates with the oil hole 40 to be continuous with the oil hole 40. On the other hand, upstream ends of the branch holes 41*b* and 41*c* are respectively open to axial both sides of the large-diameter hole 41*a*, and downstream ends 41*d* and 41*e* of the branch holes 41*b* and 41*c* are respectively open to inner circumferential surfaces of the bifurcated portions of tubular base portion 15*a* of rocker arm 15. The other structures in the fourth embodiment are similar as the first embodiment. Hence, the structures similar as the first embodiment are given the same reference signs as the first embodiment, and explanations thereof will be omitted for the purpose of simplification of the disclosure.

According to the fourth embodiment, a lubricating oil supplied from the oil supplying hole 27 to the oil hole 40 is supplied to the large-diameter hole 41*a*. Then, the lubricating oil is supplied from the large-diameter hole 41*a* to the branch holes 41*b* and 41*c* by split flow, and then, is forcibly delivered to a portion (gap) between the outer circumferential surface of control eccentric shaft 26 and the inner circumferential surfaces of the bifurcated portions of tubular base portion 15*a*. Accordingly, a lubricating property between the control eccentric shaft 26 and the tubular base portion 15*a* is favorable. Therefore, the rocker arm 15 can perform a smooth swing motion at all times.

Moreover, according to the fourth embodiment, the top surface 39*a* of third protruding portion 39 is tightly in intimate contact with the bottom surface of fitting groove 26*e* of control eccentric shaft 26. Accordingly, its sealing performance is enhanced, so that a leakage of lubricating oil between the oil hole 40 and the large-diameter hole 41*a* can be suppressed.

Moreover, according to the fourth embodiment, the axial length of tubular base portion 15*a* is relatively long together with the control eccentric shaft 26. Accordingly, a strength balance between the rocker arm 15 and the control eccentric shaft 26 is improved. In addition, a fall (inclination) of the rocker arm 15 in the axial direction of control eccentric shaft 26 can be suppressed during the swing of rocker arm 15. The other advantageous effects are same as the first embodiment.

Although the present invention has been described above with reference to the first and fourth embodiments of the present invention, the present invention is not limited to the embodiments described above. Modifications and variations of the embodiments described above will occur to those skilled in the art in light of the above teachings.

For example, the valve control apparatus according to the present invention is also applicable to an exhaust-valve side of engine. Moreover, the speed reducer according to the present invention is not limited to the ball screw mechanism 33 described above.

Moreover, in the above embodiments, the bolt 29 is described as a fixing member (fixing means) for fixing the control eccentric shaft 26 to the control shaft main body 25 by means of the axial force of the fixing member which is applied through the insertion holes and the fixing holes. However, the fixing member for fixing the control eccentric shaft 26 to the control shaft main body 25 according to the present invention is not limited to the bolt. For example, a rivet may be used as the fixing member.

Some technical structures obtainable from the above embodiments according to the present invention will now be listed as follows.

[a] A valve control apparatus for an internal combustion engine, comprising: a drive shaft (4) configured to receive a rotational drive force; a control shaft (24) including a control shaft main body (25) configured to be rotationally controlled according to a state of the engine (01), wherein the control shaft main body (25) is formed with a pair of insertion holes (25*a*) passing through the control shaft main body (25) in a radial direction of the control shaft main body (25), and a control eccentric shaft (26) located to have an eccentricity relative to a rotation center of the control shaft main body (25), wherein both ends of the control eccentric shaft (26) are formed with a pair of fixing holes (26*a*) extending in a radial direction of the control eccentric shaft (26), wherein the pair of insertion holes respectively face the pair of fixing holes (26*a*); a rocker arm (15) swingably supported by the control eccentric shaft (26) and configured to convert a rotational motion of the drive shaft (4) to a swinging motion; and a swing cam (7) configured to open and close a valve (3) of the engine (01) by swinging according to a swinging force transmitted from the swinging motion of the rocker arm (15), wherein the control eccentric shaft (26) is fixed to the control shaft main body (25) by bolts (29), wherein the bolts (29) pass respectively through the pair of insertion holes (25*a*) and are screwed respectively into the pair of fixing holes (26*a*).

[b] A valve control apparatus for an internal combustion engine, comprising: a drive shaft (4) configured to receive a rotational drive force; a control shaft (24) including a control shaft main body (25) configured to be rotationally controlled according to a state of the engine (01), wherein the control shaft main body (25) is formed with a pair of fixing holes (38*b*) extending in a radial direction of the control shaft main body (25), and a control eccentric shaft (26) located to have an eccentricity relative to a rotation center of the control shaft main body (25), wherein both ends of the control eccentric shaft (26) are formed with a pair of insertion holes (26*c*) passing through the control eccentric shaft (26) in a radial direction of the control eccentric shaft (26), wherein the pair of insertion holes (26*c*) respectively face the pair of fixing holes (38*b*); a rocker arm (15) swingably supported by the control eccentric shaft (26)

and configured to convert a rotational motion of the drive shaft (4) to a swinging motion; and a swing cam (7) configured to open and close a valve (3) of the engine (01) by swinging according to a swinging force transmitted from the swinging motion of the rocker arm (15), wherein the control eccentric shaft (26) is fixed to the control shaft main body (25) by bolts (29), wherein the bolts (29) pass respectively through the pair of insertion holes (26*c*) and are screwed respectively into the pair of fixing holes (38*b*).

[c] A valve control apparatus for an internal combustion engine, comprising: a drive shaft (4) configured to receive a rotational drive force; a control shaft (24) including a control shaft main body (25) configured to be rotationally controlled according to a state of the engine (01), wherein the control shaft main body (25) is formed with a pair of insertion holes (25*a*) passing through the control shaft main body (25) in a radial direction of the control shaft main body (25), and a control eccentric shaft (26) located to have an eccentricity relative to a rotation center of the control shaft main body (25), wherein both ends of the control eccentric shaft (26) are formed with a pair of fixing holes (26*a*) extending in a radial direction of the control eccentric shaft (26), wherein the pair of insertion holes respectively face the pair of fixing holes (26*a*); a rocker arm (15) swingably supported by the control eccentric shaft (26) and configured to convert a rotational motion of the drive shaft (4) to a swinging motion; a swing cam (7) configured to open and close a valve (3) of the engine (01) by swinging according to a swinging force transmitted from the swinging motion of the rocker arm (15); and a fixing member (29) fixing the control eccentric shaft (26) to the control shaft main body (25) by means of an axial force of the fixing member (29) which is applied through the insertion holes (25*a*) and the fixing holes (26*a*).

Accordingly, as an advantageous effect, for example, the rocker arm (15) becomes able to be easily attached to the control shaft (24) without increasing the weight of rocker arm (15).

[d] The valve control apparatus as described in the item (a), wherein the valve control apparatus further comprises: a first lubricating-oil passage (27) formed inside the control shaft main body (25), and extending in an axial direction of the control shaft main body (25); a second lubricating-oil passage (34, 40) extending from the first lubricating-oil passage (27) to an outer circumferential surface of the control shaft main body (25), and being open to the outer circumferential surface of the control shaft main body (25); and a third lubricating-oil passage (35, 41*b*, 41*c*) formed inside the control eccentric shaft (26), and communicating with the second lubricating-oil passage (34, 40), wherein lubricating oil is supplied from the first lubricating-oil passage (27) through the second lubricating-oil passage (34, 40) and the third lubricating-oil passage (35, 41*b*, 41*c*) to a sliding portion between the rocker arm (15) and the control eccentric shaft (26).

According to this structure, since the control eccentric shaft (26) is coupled and fixed to the control shaft main body (25) by the fastening force of bolts (29), a hole edge of opening end of the second lubricating-oil passage (34, 40) is brought into intimate contact with a hole edge of opening end of the third lubricating-oil passage (35, 41*b*, 41*c*) facing the opening end of second lubricating-oil passage (34, 40), by the axial force of bolts (29). Therefore, a sealing property between the both opening ends facing and abutting on each other is favorable so that a leakage of lubricating oil can be sufficiently suppressed.

[e] The valve control apparatus as described in the item (d), wherein the second lubricating-oil passage (34) is formed toward an inner circumferential surface of at least one of the pair of fixing holes (26*a*) formed inside the control eccentric shaft (26).

[f] The valve control apparatus as described in the item (a), wherein the control shaft main body (25) includes a pair of first protruding portions (28) provided in an outer circumference of the control shaft main body (25) to protrude in the radial direction of the control shaft main body (25), and the pair of insertion holes (25*a*) are formed respectively inside the pair of first protruding portions (28).

According to this structure, the control eccentric shaft (26) is supported under the state where the both end portions of control eccentric shaft (26) are respectively in contact with the tip edges (top surfaces) of the first protruding portions (28). Therefore, the eccentric amount (eccentricity) of control eccentric shaft (26) relative to the control shaft main body (25) can be arbitrarily set by setting a protruding amount of each first protruding portion (28).

[g] The valve control apparatus as described in the item (a), wherein the control shaft main body (25) includes a first cutout surface (25*b*) at one outer edge of each of the insertion holes (25*a*) which is located on a head portion (29*a*) of the bolt (29), and the first cutout surface (25*b*) is flat and perpendicular to an axis of the insertion hole (25*a*).

According to this structure, the first cutout surface (25*b*) of control shaft main body (25) can be used as a seat surface for the head portion (29*a*) of bolt (29).

[h] The valve control apparatus as described in the item (a), wherein the control eccentric shaft (26) includes a second cutout surface (26*b*) at one opening end of each of the fixing holes (26*a*) which is closer to the control shaft main body (25), and the second cutout surface (26*b*) is formed so as to cut an outer circumferential surface of the control eccentric shaft (26) to be a flat surface perpendicular to an axis of the fixing hole (26*a*).

According to this structure, when the control eccentric shaft (26) is fixed to the control shaft main body (25) by the bolts (29), the tip edge of each first protruding portion (28) becomes in contact with the corresponding flat second cutout surface (26*b*) under a press attachment by the axial force of bolts (29). Therefore, a good sealing property is ensured between the tip edges of first protruding portions (28) and the second cutout surfaces (26*b*).

[i] The valve control apparatus as described in the item (d), wherein the control shaft main body (25) includes a pair of first protruding portions (28) provided in an outer circumference of the control shaft main body (25) to protrude in the radial direction of the control shaft main body (25), wherein the pair of insertion holes (25*a*) are formed respectively inside the pair of first protruding portions (28), wherein the control shaft main body (25) includes a second protruding portion (39) at a substantially axially-center location between the pair of first protruding portions (28), the second protruding portion (39) being in contact with a substantially axially-center portion of the control eccentric shaft (26), wherein a base end portion (15*a*) of the rocker arm (15) includes a bifurcated portion formed in a bifurcated manner, the bifurcated portion being swingably supported by the control eccentric shaft (26) at locations which are axially both sides of the second protruding portion (39), wherein the second lubricating-oil passage (40) is formed inside the second protruding portion (39), wherein the third lubricating-oil passage (41*a*, 41*b*, 41*c*) is formed to branch off from a downstream opening end side of the second lubricating-oil passage (40) toward an inside of the control eccentric shaft (26), and formed to extend toward the bifurcated portion of the base end portion (15*a*) of the rocker arm (15).

According to this structure, since the base end portion (15*a*) of rocker arm (15) is formed in the bifurcated shape, the strength of the base end portion (15*a*) is enhanced while enlarging the axial length of whole of the base end portion (15*a*). Therefore, the fall (inclination) of the rocker arm (15) in the axial direction can be suppressed during the swinging motion of rocker arm (15).

[j] The valve control apparatus as described in the item (a), wherein a tubular positioning member (30) is interposed between the insertion hole (25*a*) of the control shaft main body (25) and the fixing hole (26*a*) of the control eccentric shaft (26).

According to this structure, when the control eccentric shaft (26) is attached to the control shaft main body (25), a part of the positioning member (30) is inserted and set into, e.g., the insertion hole (25*a*) of control shaft main body (25) with force in advance, and then, the fixing hole (26*a*) of control eccentric shaft (26) is engaged with a protruding end of the positioning member (30) so as to be connected with the control shaft main body (25). Therefore, the positioning for the control eccentric shaft (26) becomes easy so that the assembling operation becomes easy.

This application is based on prior Japanese Patent Application No. 2009-284628 filed on Dec. 16, 2009. The entire contents of this Japanese Patent Application are hereby incorporated by reference.

The scope of the present invention is defined with reference to the following claims.

What is claimed is:

1. A valve control apparatus for an internal combustion engine, comprising:

a drive shaft configured to receive a rotational drive force;

a control shaft including a control shaft main body configured to be rotationally controlled according to a state of the engine, wherein the control shaft main body is formed with a pair of insertion holes passing through the control shaft main body in a radial direction of the control shaft main body, and a control eccentric shaft located to have an Eccentricity relative to a rotation center of the control shaft main body, wherein both ends of the control eccentric shaft are formed with a pair of fixing holes extending in a radial direction of the control eccentric shaft, wherein the pair of insertion holes respectively face the pair of fixing holes;

a rocker arm swingably supported by the control eccentric shaft and configured to convert a rotational motion of the drive shaft to a swinging motion; and a swing cam configured to open and close a valve of the engine by swinging according to a swinging force transmitted from the swinging motion of the rocker arm, wherein the control eccentric shaft is fixed to the control shaft main body by bolts, wherein the bolts pass respectively through the pair of insertion holes and are screwed respectively into the pair of fixing holes.

2. The valve control apparatus as claimed in claim 1, wherein the valve control apparatus further comprises:

a first lubricating-oil passage formed inside the control shaft main body, and extending in an axial direction of the control shaft main body;

a second lubricating-oil passage extending from the first lubricating-oil passage to an outer circumferential surface of the control shaft main body, and being open to the outer circumferential surface of the control shaft main body; and a third lubricating-oil passage formed inside the control eccentric shaft, and communicating with the second lubricating-oil passage, wherein lubricating oil is supplied from the first lubricating-oil passage through the second lubricating-oil passage and the third lubricating-oil passage to a sliding portion between the rocker arm and the control eccentric shaft.

3. The valve control apparatus as claimed in claim 2, wherein the second lubricating-oil passage is formed toward an inner circumferential surface of at least one of the pair of fixing holes formed inside the control eccentric shaft.

4. The valve control apparatus as claimed in claim 2, wherein the control shaft main body includes a pair of first protruding portions provided in an outer circumference of the control shaft main body to protrude in the radial direction of the control shaft main body, wherein the pair of insertion holes are formed respectively inside the pair of first protruding portions, wherein the control shaft main body includes a second protruding portion at a substantially axially-center location between the pair of first protruding portions, the second protruding portion being in contact with a substantially axially-center portion of the control eccentric shaft, wherein a base end portion of the rocker arm includes a bifurcated portion formed in a bifurcated manner, the bifurcated portion being swingably supported by the control eccentric shaft at locations which are axially both sides of the second protruding portion, wherein the second lubricating-oil passage is formed inside the second protruding portion, wherein the third lubricating-oil passage is formed to branch off from a downstream opening end side of the second lubricating-oil passage toward an inside of the control eccentric shaft, and formed to extend toward the bifurcated portion of the base end portion of the rocker arm.

5. The valve control apparatus as claimed in claim 1, wherein the control shaft main body includes a pair of first protruding portions provided in an outer circumference of the control shaft main body to protrude in the radial direction of the control shaft main body, and the pair of insertion holes are formed respectively inside the pair of first protruding portions.

6. The valve control apparatus as claimed in claim 1, wherein the control shaft main body includes a first cutout surface at one outer edge of each of the insertion holes which is located on a head portion of the bolt, and the first cutout surface is flat and perpendicular to an axis of the insertion hole.

7. The valve control apparatus as claimed in claim 1, wherein the control eccentric shaft includes a second cutout surface at one opening end of each of the fixing holes which is closer to the control shaft main body, and the second cutout surface is formed so as to cut an outer circumferential surface of the control eccentric shaft to be a flat surface perpendicular to an axis of the fixing hole.

8. The valve control apparatus as claimed in claim 1, wherein a tubular positioning member is interposed between the insertion hole of the control shaft main body and the fixing hole of the control eccentric shaft.

9. A valve control apparatus for an internal combustion engine, comprising:

a drive shaft configured to receive a rotational drive force;

a control shaft including a control shaft main body configured to be rotationally controlled according to a state of the engine, wherein the control shaft main body is formed with a pair of fixing holes extending in a radial direction of the control shaft main body, and a control eccentric shaft located to have an eccentricity relative to a rotation center of the control shaft main body, wherein both ends of the control eccentric shaft are formed with a pair of insertion holes passing through the control eccentric shaft in a radial direction of the control eccentric shaft, wherein the pair of insertion holes respectively face the pair of fixing holes;

a rocker arm swingably supported by the control eccentric shaft and configured to convert a rotational motion of the drive shaft to a swinging motion; and a swing cam configured to open and close a valve of the engine by swinging according to a swinging force transmitted from the swinging motion of the rocker arm, wherein the control eccentric shaft is fixed to the control shaft main body by bolts, wherein the bolts pass respectively through the pair of insertion holes and are screwed respectively into the pair of fixing holes.

10. A valve control apparatus for an internal combustion engine, comprising:

a drive shaft configured to receive a rotational drive force;

a control shaft including a control shaft main body configured to be rotationally controlled according to a state of the engine, wherein the control shaft main body is formed with a pair of insertion holes passing through the control shaft main body in a radial direction of the control shaft main body, and a control eccentric shaft located to have an eccentricity relative to a rotation center of the control shaft main body, wherein both ends of the control eccentric shaft are formed with a pair of fixing holes extending in a radial direction of the control eccentric shaft, wherein the pair of insertion holes respectively face the pair of fixing holes;

a rocker arm swingably supported by the control eccentric shaft and configured to convert a rotational motion of the drive shaft to a swinging motion;

a swing cam configured to open and close a valve of the engine by swinging according to a swinging force transmitted from the swinging motion of the rocker arm; and a fixing member fixing the control eccentric shaft to the control shaft main body by means of an axial force of the fixing member which is applied through the insertion holes and the fixing holes.

* * * * *